US006617001B1

(12) United States Patent
Arnold

(10) Patent No.: US 6,617,001 B1
(45) Date of Patent: Sep. 9, 2003

(54) FLOATABLE FLAT TEXTILE STRUCTURE AND AIR CUSHIONING CABLES THEREFOR

(75) Inventor: Rolf Arnold, Dresden (DE)

(73) Assignee: Manfred Huck GmbH & Co., Asslar-Berghausen (DE)

( * ) Notice: Subject to any disclaimer, the term of this patent is extended or adjusted under 35 U.S.C. 154(b) by 0 days.

(21) Appl. No.: 09/673,500

(22) PCT Filed: Feb. 16, 2000

(86) PCT No.: PCT/EP00/01274

§ 371 (c)(1),
(2), (4) Date: Oct. 16, 2000

(87) PCT Pub. No.: WO00/49214

PCT Pub. Date: Aug. 24, 2000

(30) Foreign Application Priority Data

Feb. 16, 1999 (DE) ..... 199 06 336
Feb. 16, 1999 (DE) ..... 199 06 337

(51) Int. Cl.[7] ..... B32B 3/00

(52) U.S. Cl. ..... 428/72; 428/69; 428/178; 428/188; 428/304.4; 428/314.4

(58) Field of Search ..... 428/188, 304.4, 428/178, 72, 69, 314.4

(56) References Cited

U.S. PATENT DOCUMENTS 3,798,913 A * 3/1974 Dubois ..... 61/1 F

FOREIGN PATENT DOCUMENTS

| | | |
|---|---|---|
| DE | 19654031 | 12/1996 |
| EP | 0448714 | 10/1989 |
| EP | 066364 | 7/1994 |
| FR | 255724 | 11/1983 |
| GB | 1054404 | * 1/1967 |
| GB | 2042003 | 2/2000 |
| WO | WO 97/09481 | 3/1997 |

OTHER PUBLICATIONS

PCT/EP00/01274, Aug. 24, 2000, PCT Search Report.

* cited by examiner

*Primary Examiner*—Elizabeth M. Cole
*Assistant Examiner*—Jeremy R. Pierce
(74) *Attorney, Agent, or Firm*—Foley Hoag LLP

(57) ABSTRACT

A floatable flat textile structure with embedded, air-filled floating bodies is disclosed. To provide a flat structure that has a high buoyancy, resists damage and can be manufactured cost-effectively, the floating bodies are formed as air-filled ropes made of an air-filled foil, wherein the air-filled ropes are connected by connecting elements.

20 Claims, 2 Drawing Sheets

FLOATABLE FLAT TEXTILE STRUCTURE AND AIR CUSHIONING CABLES THEREFOR

FIELD OF THE INVENTION

The invention relates to a floatable flat textile structure, as well as to air-cushioning cables for such flat textile structure.

BACKGROUND OF THE INVENTION

Conventional floating flat textile structures can be made, for example, of coated two-ply textile structures that are filled with air. Such structures tend to expensive since they consist of relatively finely-woven fabrics and, in addition, have to be coated.

DE 195 54 031 A1 proposes embedding tubes or hoses filled with air, resulting in a complicated assembly process, because the cut ends of the hollow members have to be closed. Moreover, the tubes or hoses of large-area structures may be accidentally damaged, allowing water to enter which decreases the buoyancy.

EP 0 666 364 A2 discloses a floating rope having a core made of expanded plastic material and a jacket made of textile threads laid on the core. This floating rope is quite stiff and thick and has a small bending radius, and is therefore unsuitable for use as a floatable flat textile structure.

In addition, WO 97/09481 discloses a floating rope having a core made of a center nylon rope, with a plurality of floating elements consisting of expanded plastic and so-called buffer elements, being arranged on the nylon rope. The outer jacket of the floating rope is formed of a protective layer made of polyurethane.

DE 36 34 307 A1 discloses a flat textile structure that includes a backing fabric made of warp threads in the form of stitch wales. The stitch wales are connected by weft threads. On one side of the backing fabric, a figure warp is applied to form the weft and the figure. The figure thread is connected at least over a section to the backing fabric by way of at least one stitch wale from an auxiliary weft thread. This arrangement produces a novel, versatile method for patterning the flat textile structure.

DE-OS 17 60 535 also describes floatable ropes. These ropes require an additional core made of parallel threads which together with the floatable components is surrounded by a relatively dense mesh or woven structure. The manufacture of such ropes is therefore quite inefficient. Other floating ropes are known that have cylindrical floating bodies arranged on the rope.

DD (WP) 11 64 79 also discloses a rope-like and cord-like product that can be used preferably in building construction for sealing cracks as well as in other applications, such as floating lines. In this rope construction, the floatable filler material is surrounded by a mesh structure composed of threads.

A cord and rope product having the aforedescribed features is known from EP 0 666 364 A2. The floating rope consists of two or more strands, wherein each of the strands has a core-jacket structure. The core is here formed as a floating body made of plastic tubes filled with an expanded plastic or a gas. Optionally, the tubes can have an occasional constriction along their longitudinal extent. Using a rope-laying technique, the form providing the buoyancy is surrounded with a plurality of textile threads having a substantial density and thickness. This prior art floating rope is relatively expensive to manufacture; moreover, the large number of textile threads which surround the floating body do not contribute to the buoyancy, but rather reduce the buoyancy.

It is therefore an object of the invention to provide a floating flat textile structure that has a high buoyancy, is not easily damaged, and can be manufactured cost-effectively.

SUMMARY OF THE INVENTION

According to one aspect of the invention, the floating bodies embedded in the floatable textile structure are air-filled ropes made of an air-filled foil, wherein the air-filled ropes are tied together with connecting elements.

The essential advantage of the floating flat textile structure according to the invention is that cord and cable products made of an air cushioning film, such as air cellular cushioning sold under the trademark Bubble Wrap® by Sealed Air Corporation of Saddle Brook, N.J. in the form of coarse threads provide a very high buoyancy. In addition, the flat textile structure is easy to assemble and inexpensive, because the cut ends of the air cushioning film do not have to be sealed. When the embedded air cushioning cables are locally damaged, only a relatively small loss of buoyancy can be expected due to the large number of air chambers within the air cushioning film. Moreover, the flat structure according to the invention is water-tight.

According to an embodiment of the invention, the flat structure of the invention includes an air cushioning cable formed as a strand-like air cushioning film, with the air cushioning film being surrounded by textile threads that protect the air cushioning film from mechanical damage. The textile threads can be arranged in the form of a mesh-type jacket with preferably widely spaced and coarse stitches.

Particularly compact floating cables with a high elastic cross-sectional compression characteristic can be manufactured by surrounding the strand-like air cushioning film directly with a coarse-mesh jacket made of threads that apply a constriction force to the air cushioning film in the radial direction.

According to another embodiment of the invention, the air cushioning film can be protected against the radiation effects by surrounding the air cushioning film with a UV protective film.

According to an advantageous embodiment, the air-filled ropes can be embedded either in a meander pattern or so as to extend in a longitudinal direction. The air-filled ropes can also be embedded in a composite material.

Additional objects, advantages, features and applications of the aforedescribed invention are described in the following description of embodiments when read in conjunction with the drawings. All the described and/or illustrated features alone or in combination represent the subject matter of the present invention, independent of their combination in the claims or their dependency.

DETAILED DESCRIPTION OF CERTAIN EMBODIMENTS

Figure 1:
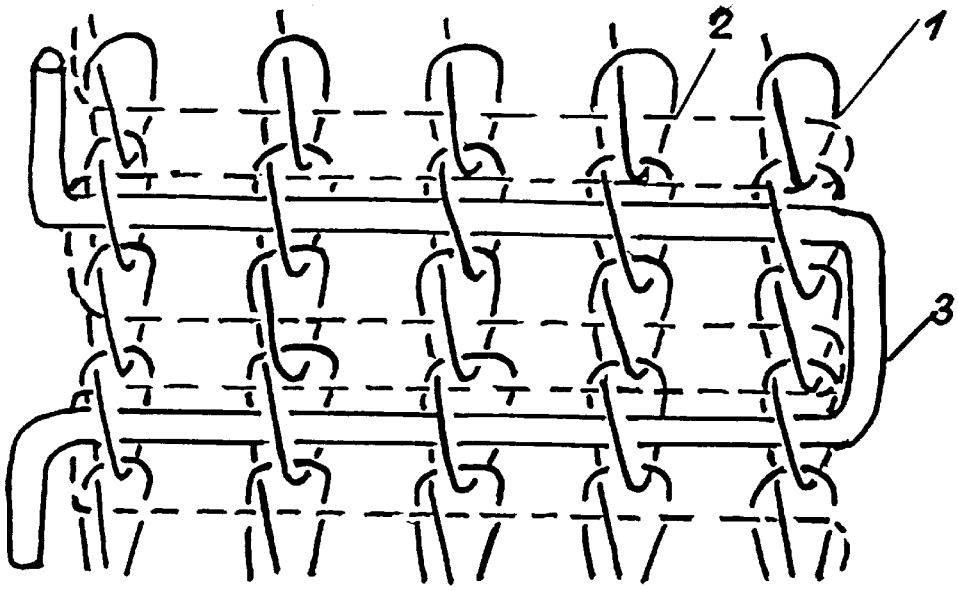
FIG. 1 shows a first embodiment of a floatable flat textile structure according to the invention.

FIG. 1 illustrates a floatable flat textile structure in the form of a warp knit fabric with an embedded air cushioning cable 3 having a meander pattern.

Figure 2:
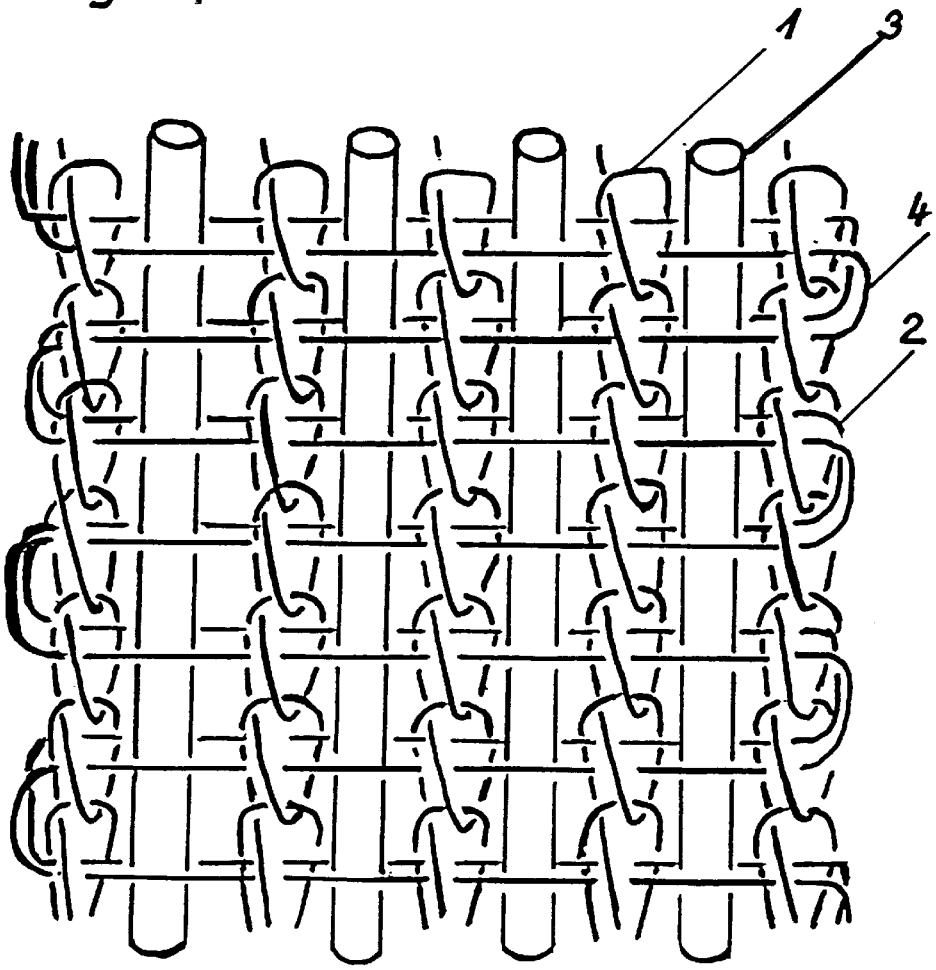
FIG. 2 shows a second embodiment of the floating flat textile structure according to the invention.

FIG. 2 shows an arrangement with air cushioning cable 3 that extend only in a longitudinal direction of the flat structure. A particularly high area coverage and transverse stability can be achieved by incorporating an additional system made of weft threads 4. The threads 2, 4 embedded as a weft insertion can also have the form of sectional wefts. The floating flat textile structure can also be formed as a mesh-like structure. In this case, the spacing of the stitch wales 1 as well as the spacing of the weft threads 2, 4 should be increased accordingly. According to the invention, the air cushioning film can also be arranged in a bonded composite fabric.

Figure 3:
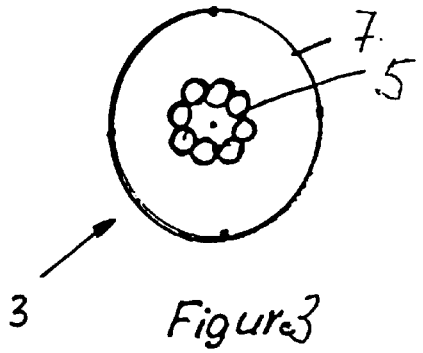
FIG. 3 is a cross-sectional view of a first embodiment of an air cushioning cable according to the invention for a flat textile structure according to FIGS. 1 and 2, FIG. 4 a cross-sectional view of a second embodiment of an air cushioning cable with an additional UV protective film, and FIG. 5 a third embodiment of an air cushioning cable, wherein the strand-like core is made of an air cushioning film and surrounded by a coarse-mesh jacket made of threads.

The air cushioning cable 3 depicted in FIG. 3 has a core-jacket structure with a diameter of approximately 25 mm. An air cushioning film 5, such as, for example, air cellular cushioning sold under the trademark Bubble Wrap® by Sealed Air Corporation of Saddle Brook, N.J., formed to be strand-like is arranged in the core. The strands of the air cushioning film 5 can be formed directly on a casing machine, such as a core-jacket braiding machine, from a flat film using conventional folding devices and funnel-shaped guide elements, with the air cushioning film 5 being fed to the center of the braiding head.

To protect the core material from mechanical damage and deterioration caused by UV radiation, the jacket should have relatively closely spaced threads and/or stitches.

Figure 4:
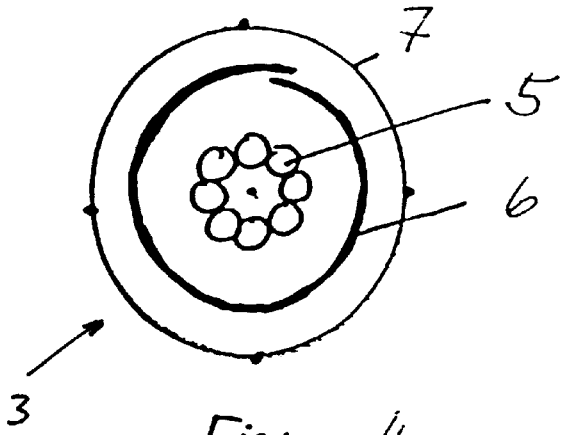

The buoyant air cushioning cable depicted in FIG. 4 is intended for further processing on an extremely coarse knitting machine and includes a preferably coarsely stitched mesh-like jacket 7 made of threads.

This results in lower material costs as compared to a denser jacket made of threads and having narrow stitches.

Figure 5:
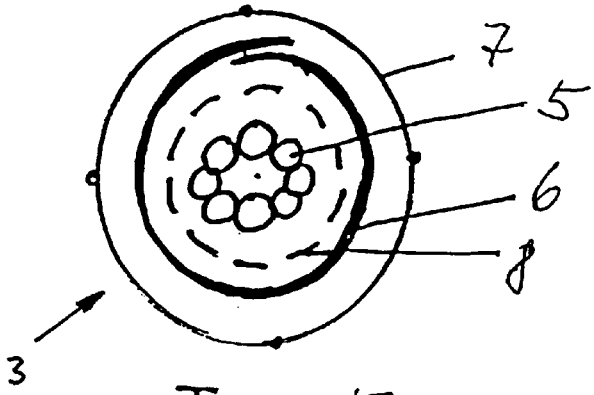

The air cushioning film 5 formed of strands is completely surrounded by a UV protective film 6, as shown in FIGS. 4 and 5. An opaque UV-resistant flat film that can be manufactured inexpensively, can be used for this purpose.

The entire cable structure can be manufactured particularly efficiently on a knitting machine employing grippers. Compact cables with high elastic transverse compression characteristics can be manufactured by providing the air cushioning film 4, which is formed to be strand-like, depicted in FIG. 5 with an additional taut mesh like jacket made of threads 8.

I claim:

1. A buoyant flat textile structure comprising at least one buoyant body embedded in the textile structure and being formed of a plurality of air cushioning cables, with the air cushioning cable being made from at least one air cushioning film, the air cushioning film comprising a plurality of air-filled cells, and a plurality of connecting elements that connect the air cushioning cables with each other.

2. The flat textile structure of claim 1, wherein the air cushioning cables are embedded in a meander pattern.

3. The flat textile structure of claim 1, wherein the air cushioning cables are embedded so as to extend in a longitudinal direction of the buoyant body.

4. The flat textile structure according to claim 1, wherein the air cushioning cables are arranged in a composite material.

5. An air cushioning cable for use in a buoyant body, comprising at least one air cushioning film, the air cushioning film comprising a plurality of air-filled cells, wherein the air cushioning film is formed into a hollow strand and surrounded by textile threads.

6. An air cushioning cable according to claim 5, wherein the textile threads are arranged so as to form a mesh-type jacket with widely spaced or coarse stitches.

7. An air cushioning cable according to claim 5, wherein the textile threads are arranged in the form of a tubular or hollow woven structure having closely spaced stitches.

8. An air cushioning cable according to claim 5, wherein the textile threads form a coarse-mesh jacket that surrounds the air cushioning film.

9. An air cushioning cable according to claim 5, further comprising a UV-protective foil surrounding the air cushioning film.

10. An air cushioning cable according to claim 8, wherein the coarse-mesh jacket is placed tautly around the air cushioning film.

11. An air cushioning cable according to claim 5, wherein the textile threads form a first jacket surrounding the at least one air cushioning film and a second jacket different from the first jacket, with the second jacket surrounding the first jacket.

12. An air cushioning cable according to claim 11, wherein a UV-protective film is disposed between the first and second jacket.

13. A buoyant flat textile structure comprising at least one buoyant body embedded in the textile structure and being formed of a plurality of air cushioning cables, with a respective air cushioning cable being made of at least one air cushioning film formed into strands, the air cushioning film comprising a plurality of air-filled cells, a jacket made of textile threads and surrounding the at least one air cushioning film, and a plurality of connecting elements that connect the air cushioning cables with each other.

14. A buoyant flat textile structure, comprising:

at least one buoyant body embedded in the textile structure and being formed of an air cushioning cable having a meander pattern, the air cushioning cable being made from at least one air cushioning film, the air cushioning film comprising a plurality of air-filled cells, and a plurality of connecting elements forming the air cushioning cable in the meander pattern.

15. An air cushioning cable according to claim 14, further comprising textile threads forming a coarse-mesh jacket that surrounds the air cushioning film.

16. An air cushioning cable according to claim 15, wherein the coarse-mesh jacket is placed tautly around the air cushioning film.

17. An air cushioning cable according to claim 14, further comprising a UV-protective foil surrounding the air cushioning film.

18. An air cushioning cable according to claim 14, further comprising:

textile threads forming a first jacket surrounding the air cushioning film; and a second jacket surrounding the first jacket.

19. An air cushioning cable according to claim 18, wherein a UV-protective film is disposed between the first and second jacket.

20. A buoyant flat textile structure, comprising:

at least one buoyant body embedded in the textile structure and being formed of an air cushioning cable having a meander pattern, the air cushioning cable being made of at least one air cushioning film formed into strands, the air cushioning film comprising a plurality of air-filled cells, a jacket made of textile threads and surrounding the at least one air cushioning film, and a plurality of connecting elements forming the air cushioning cable in the meander pattern.

* * * * *